US011598195B2

(12) United States Patent
Hohl et al.

(10) Patent No.: US 11,598,195 B2
(45) Date of Patent: Mar. 7, 2023

(54) STATISTICAL APPROACH TO INCORPORATE UNCERTAINTIES OF PARAMETERS IN SIMULATION RESULTS AND STABILITY ANALYSIS FOR EARTH DRILLING

(71) Applicants: Andreas Hohl, Hannover (DE); Oliver Hoehn, Hannover (DE); Armin Kueck, Hannover (DE)

(72) Inventors: Andreas Hohl, Hannover (DE); Oliver Hoehn, Hannover (DE); Armin Kueck, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1334 days.

(21) Appl. No.: 14/524,070

(22) Filed: Oct. 27, 2014

(65) Prior Publication Data

US 2016/0117424 A1 Apr. 28, 2016

(51) Int. Cl.
*E21B 44/00* (2006.01)
*E21B 7/00* (2006.01)

(52) U.S. Cl.
CPC ..... *E21B 44/00* (2013.01); *E21B 7/00* (2013.01)

(58) Field of Classification Search
CPC ..... E21B 44/00; E21B 7/00
USPC ..... 703/2
See application file for complete search history.

(56) References Cited

U.S. PATENT DOCUMENTS 4,791,998 A 12/1988 Hempkins et al.
5,316,091 A 5/1994 Rasi et al.
5,508,915 A 4/1996 Tsao et al.
6,549,854 B1 4/2003 Malinverno et al.
7,590,516 B2 9/2009 Jourdan et al.
8,073,800 B2 12/2011 Prange et al.
(Continued)

FOREIGN PATENT DOCUMENTS

EP 0354716 A1 2/1990
WO 2013140239 A1 9/2013
WO 2014055352 A1 4/2014

OTHER PUBLICATIONS

Brett, J. F. (Sep. 1, 1992). The Genesis of Bit-Induced Torsional Drillstring Vibrations. Society of Petroleum Engineers, doi: 10.2118/21943-PA.*

(Continued)

*Primary Examiner* — Saif A Alhija
(74) *Attorney, Agent, or Firm* — Cantor Colburn LLP

(57) ABSTRACT

A method for estimating a probability of a drilling dysfunction or a drilling performance indicator value occurring includes entering drilling-related data having a probability distribution into a mathematical model of a drill string drilling a borehole penetrating the earth and entering drilling parameters into the model for drilling the borehole. The method further includes performing a plurality of drilling simulations using the model, each simulation providing a probability of the drilling dysfunction occurring or a probability of a drilling performance indicator value occurring with associated drilling parameters used in the simulation, selecting a set of drilling parameters that optimizes a drilling objective using the probabilities of the drilling dysfunction occurring or the probabilities of a drilling performance indicator value occurring; and transmitting the selected set of drilling parameters to a signal receiving device.

20 Claims, 9 Drawing Sheets

(56) References Cited

U.S. PATENT DOCUMENTS

| | | | | |
|---|---|---|---|---|
| 8,364,404 | B2 | 1/2013 | Legendre et al. | |
| 8,457,897 | B2 | 6/2013 | Hehmeyer | |
| 8,457,997 | B2 | 6/2013 | Narayanan et al. | |
| 8,527,248 | B2 | 9/2013 | Thambynayagam et al. | |
| 8,838,426 | B2 * | 9/2014 | Aldred | E21B 41/0092 703/10 |
| 2006/0195307 | A1 * | 8/2006 | Huang | E21B 10/00 703/7 |
| 2007/0144740 | A1 * | 6/2007 | Guo | G01V 5/104 166/254.2 |
| 2010/0155142 | A1 | 6/2010 | Michael et al. | |
| 2010/0191516 | A1 * | 7/2010 | Benish | E21B 43/00 703/10 |
| 2011/0186353 | A1 * | 8/2011 | Turner | G01V 9/00 175/40 |
| 2012/0118637 | A1 | 5/2012 | Wang et al. | |
| 2012/0123756 | A1 * | 5/2012 | Wang | E21B 44/00 703/2 |
| 2013/0262069 | A1 * | 10/2013 | Leonard | E21B 43/00 703/10 |
| 2013/0341093 | A1 * | 12/2013 | Jardine | E21B 44/00 175/40 |
| 2014/0116776 | A1 | 5/2014 | Marx et al. | |
| 2014/0122037 | A1 | 5/2014 | Prange et al. | |

OTHER PUBLICATIONS

Binder, K.; "Monte Carlo Methods in Statistical Physics"; (1979); Springer, Berlin. 4 pages.

Blobel; "Statistische Und Numerische Methoden Der Datenanlyse"; (1998); 2 pages.

Blobel; "Statistische Und Numerische Methoden Der Datenanlyse"; (1998); 3 pages.

Dykstra, Mark William; "Nonlinear Drill String Dynamics"; The University of Tulsa The Graduate School; (1996); 282 pages.

Eren, "Real-Time-Optimization of Drilling Parameters During Drilling Operations", A Thesis Submitted to the Graduate School of Natural and Applied Sciences of Middle East Technical University, Feb. 2010, 165 pages.

Heisig, G; "Zum statischen und dynamischen verhalten von tiefbohrstrangen in raumlich gekrummten Bohrlochern"; (1993) Braunschweig; 71 pages.

Jansen, J.D; "Nonlinear dynamics of oilwell drillstrings"; (1993); Delft University Press; 241 pages.

Notification of Transmital of the International Search Report and the Written Opinion of the International Searching Authority, or the Declaration; PCT/US2015/057562; dated Jan. 7, 2016, 13 pages.

Ostermeyer, Georg-Peter, et al.; "Modeling of the dynamic phenomena "stick-slip" and "whirl" of a drill string demonstrator"; (2013); Proc. Appl. Math Mech; 2 pages.

Rudat, Jens, et al., "Development of an Innovative Model-Based Stick/Slip Control System", SPE/IADC 139996, Mar. 2011, 12 pages.

* cited by examiner

STATISTICAL APPROACH TO INCORPORATE UNCERTAINTIES OF PARAMETERS IN SIMULATION RESULTS AND STABILITY ANALYSIS FOR EARTH DRILLING

BACKGROUND

Earth formations may be used for various purposes such as hydrocarbon production, geothermal production, and carbon dioxide sequestration. Boreholes are drilled into the earth formations to gain access to them. The boreholes are typically drilled by using a drill string having a drill bit at the far end. Torque and weight are applied to the drill string by a drill rig in order to rotate the drill bit and provide a force to cut through formation rock. Forces other than those applied by the drill rig are also imposed on the drill string. These other forces are applied by the formation itself as it makes contact with the drill string and the drill bit. The total sum of a certain combination of forces acting on the drill string however can cause drilling dysfunctions such as stick-slip and whirl. Unfortunately, drilling dysfunctions can lead to equipment damage, drilling downtime and associated costs. Hence, it would be well received in the drilling industry if methods were developed to predict with a known level of certainty when a drilling dysfunction will occur.

BRIEF SUMMARY

Disclosed is a method for estimating a probability of a drilling dysfunction occurring or a probability of a drilling performance indicator value occurring. The method includes: entering drilling-related data having a probability distribution into a mathematical model of a drill string drilling a borehole penetrating the earth; entering drilling parameters into the model for drilling the borehole; and performing a plurality of drilling simulations using the model, each simulation providing a probability of the drilling dysfunction occurring or a probability of a drilling performance indicator value occurring with associated drilling parameters used in the simulation; selecting a set of drilling parameters that optimizes a drilling objective using the probabilities of the drilling dysfunction occurring or the probabilities of a drilling performance indicator value occurring; and transmitting the selected set of drilling parameters to a signal receiving device; wherein entering drilling-related data, entering drilling parameters, performing a plurality of drilling simulations and selecting a set of drilling parameters are performed using a processor.

Also disclosed is a non-transitory computer readable medium having computer-readable instruction for estimating a probability of a drilling dysfunction occurring or a probability of a drilling performance indicator value occurring that when executed by a computer implements a method that includes: entering drilling-related data having a probability distribution into a mathematical model of a drill string drilling a borehole penetrating the earth; entering drilling parameters into the model for drilling the borehole; performing a plurality of drilling simulations using the model, each simulation providing a probability of the drilling dysfunction occurring or a probability of a drilling performance indicator value occurring with associated drilling parameters used in the simulation; and selecting a set of drilling parameters that optimizes a drilling objective using the probabilities of the drilling dysfunction occurring or the probabilities of a drilling performance indicator value occurring; and transmitting the selected set of drilling parameters to a signal receiving device.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed is a method, which may be implemented by a computer for estimating a probability or likelihood of a drilling dysfunction occurring. A mathematical model of a drill string used to drill a borehole is used to perform mathematical simulations of the drilling process. The model is populated with drilling-related data having a probability distribution and with known drilling parameters. A plurality of drilling simulations is performed with each simulation providing whether a drilling dysfunction occurred or not, the drilling parameters used for that simulation, and a probability of the drilling dysfunction occurring or not occurring based upon the probability distribution of the drilling related data entered into the model. A probabilistic stability map can then be generated from all of the data from the plurality of drilling simulations. Once the probabilistic stability map is generated, the map can be displayed to a drilling operator to make decisions for manually controlling the drilling parameters to avoid the drilling parameters that may lead to unstable drilling or dysfunctions. Alternatively or in addition to the operator display, the values of the probabilistic stability map may be entered into a controller for automatically controlling the drilling parameters to avoid the drilling parameters that may lead to unstable drilling or dysfunctions. Computational time for performing the simulations may be reduced by performing the simulations using different models having different fidelity levels of representing the drill string. If a lower fidelity model provides similar results as a higher fidelity model, the lower fidelity model can be used going forward with the corresponding benefit of requiring less computational time to provide quicker results.

Figure 1:
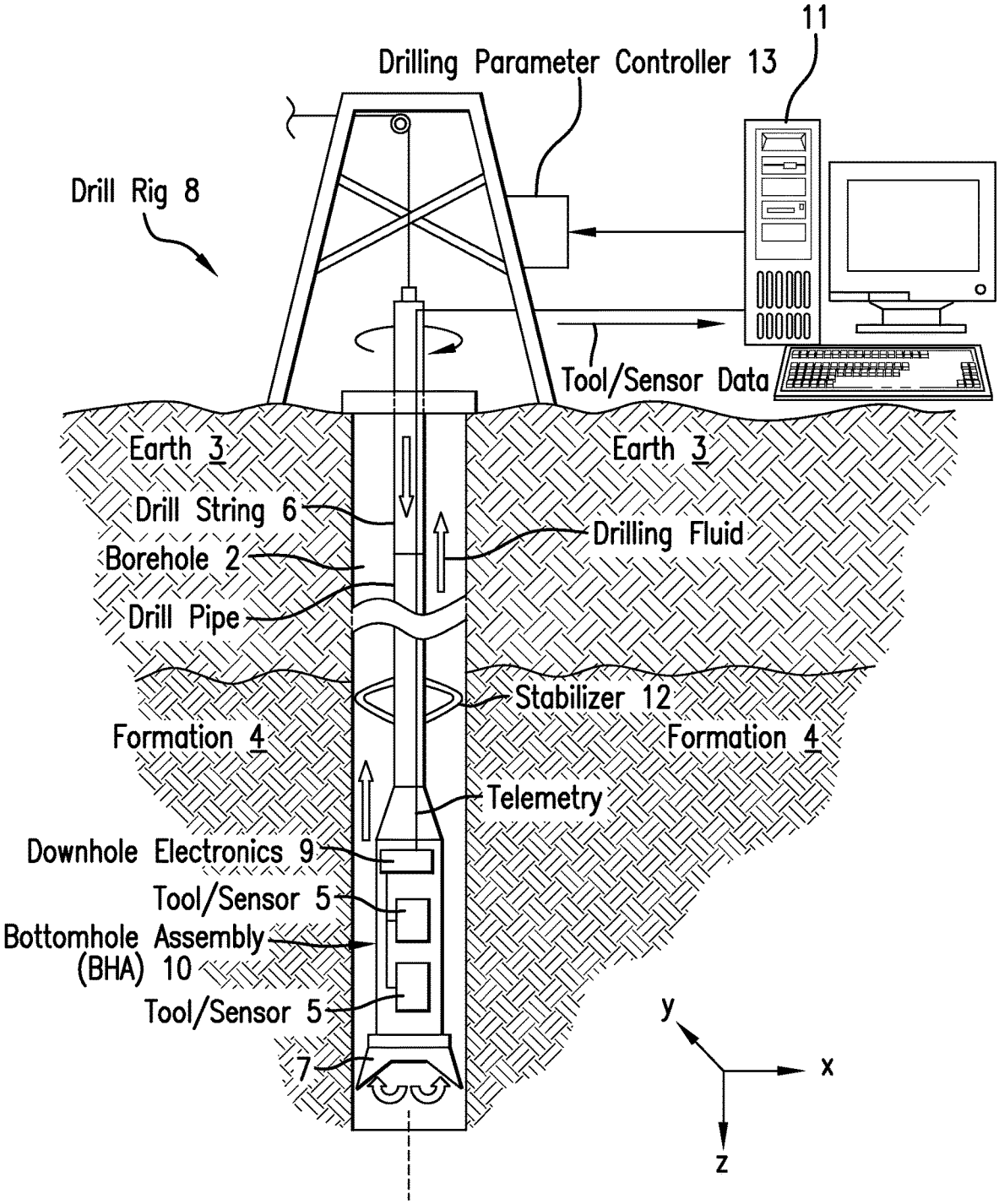
FIG. 1 illustrates a cross-sectional view of an exemplary embodiment of an drill string configured for drilling a borehole in the earth.

FIG. 1 illustrates a cross-sectional view of an exemplary embodiment of a drill string 6 disposed in a borehole 2 penetrating the earth 3, which includes an earth formation 4. The formation 4 represents any subsurface material of interest that may be drilled by the drill string 6 that may be made up of jointed pipe. A drill bit 7 is disposed at the distal end of the drill string 6. A drill rig 8 is configured to conduct drilling operations such as rotating the drill string 6 and thus the drill bit 7 in order to drill the borehole 2. The conduct of drilling operations includes applying selected or known forces to the drill string and drill bit. To rotate the drill string 6 at a selected rotational speed, the drill rig 8 can apply a torque to the drill string 6. In addition, the drill rig 8 can apply a selected downward force on the drill string 6 in order to achieve a selected weight-on-bit. Further, the drill rig 8 is configured to pump drilling fluid (i.e., drilling mud) through the drill string 6 in order to lubricate the drill bit 7 and flush cuttings from the borehole 2. The pumping of the drilling fluid at a selected flow rate is another force applied to the drill string 6. A bottomhole assembly (BHA) 10 is included in the drill string 6 and may include the drill bit 7. The BHA 10 may also include various downhole tools and sensors 5 for sensing various downhole properties. A stabilizer 12 may be disposed in the drill string 6 in order to mechanically stabilize the BHA in the borehole to avoid unintentional sidetracking, vibrations, and ensure the quality of the hole being drilled. Downhole electronics 9 are configured to operate the downhole tools and sensors 5, process measurement data obtained downhole, and/or act as an interface with telemetry to communicate data or commands between downhole components and a computer processing system 11 disposed at the surface of the earth 3. Non-limiting embodiments of the telemetry include pulsed-mud and wired drill pipe. System operation and data processing operations may be performed by the downhole electronics 9, the computer processing system 11, or a combination thereof. The downhole tools and sensors 5 may be operated continuously or at discrete selected depths in the borehole 2. The process of measuring or sensing the various downhole properties may be referred to as logging-while-drilling (LWD) or measurement-while-drilling (MWD). A controller 13, which may be included in the downhole electronics 9 and/or the computer processing system 11, is configured to control drilling parameters used to drill the borehole 2. In one or more embodiments, the controller 13 is configured to accept a drilling parameter setpoint for closed-loop control of the corresponding drilling parameter.

Figure 2:
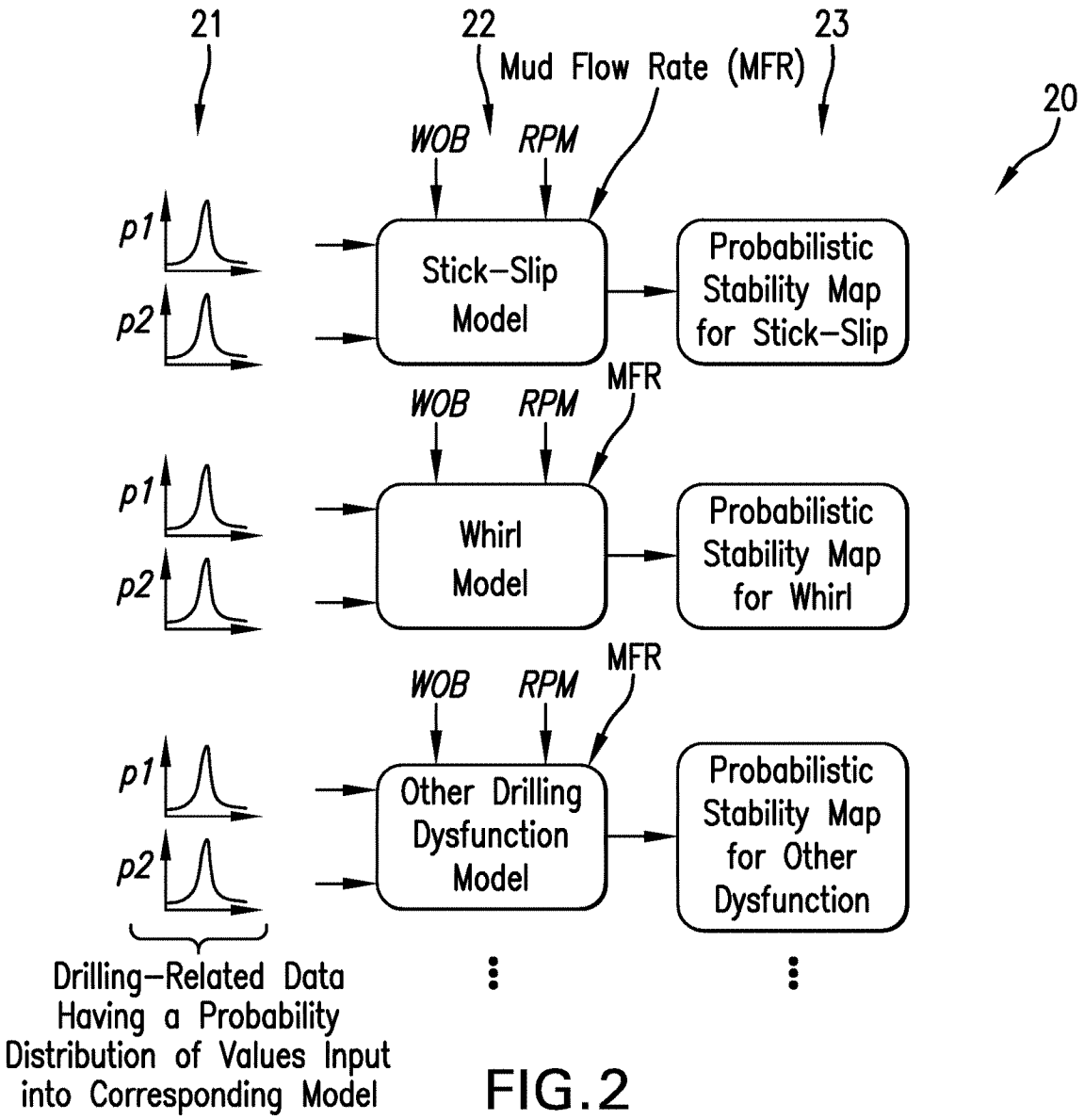
FIG. 2 is a flow chart for a method of predicting drilling stability with a known probability distribution for certain drilling dysfunctions.

Refer now to FIG. 2, which presents a flow chart for a method 20 of predicting drilling stability with a known probability for certain drilling dysfunctions. One or more method steps in the method 20 may be performed by a processor such as in a computer processing system. Block 21 calls for entering drilling-related data having a probability distribution into a mathematical model of a drill string drilling a borehole penetrating the earth using a drill string. The mathematical model represents the structure of the drill string and forces acting on the drill string. It can be appreciated that various types of mathematical models may be used having various levels of fidelity or complexity in representing the drill string. In one or more embodiments, the model may be a finite-element model (FEM), which has a high level of representation fidelity compared to simpler or less complex models such as lumped mass models and reduced order models. One of ordinary skill in the art would understand the various types of mathematical models that may be used to represent the drill string upon reading this disclosure. Non-limiting examples of the drilling-related data include formation lithology, borehole dimensions, and borehole trajectory. From the formation lithology, various formation parameters such as rock hardness may be determined for modelling how the drill string and drill bit interact with the formation rock. The values of the various drilling related data are generally not known exactly, but have a probability distribution associated with a spread of values. For example, several measurements may be made of a certain drilling related parameter. An example of a probability distribution is the normal distribution characterized by a mean value and a variance. The Cholesky decomposition could be used to also address the covariance (correlation) between different input parameters. One example for this type of parameter may be the friction factor between a stabilizer and the borehole. This parameter is probably correlated with parameters of the falling torque characteristic with respect to the RPM. The drilling related data may be obtained from offset borehole drilled into the same formation presently being drilled, borehole drilled into formations similar to the one being drilled, from previously obtained models of the formation and similar drill strings, and from measurements performed by the tools and sensor 5 disposed on the drill string presently drilling the borehole. The tools and sensors 5 may perform a plurality of measurements, which can be used to provide a probability distribution of measured values that can be characterized by a mean and standard deviation. Block 22 calls for entering drilling parameters into the model for drilling the borehole. Non-limiting embodiments of the drilling parameters include weight-on-bit (WOB), rotational speed (revolutions per minute or RPM), and drilling fluid flowrate. The drilling parameters are generally known and may be constant. Block 23 calls for performing a plurality of drilling simulations using the model. Each simulation may provide a probability of a selected drilling dysfunction occurring (or not occurring) with associated drilling parameters used in the simulation.

Figure 3:
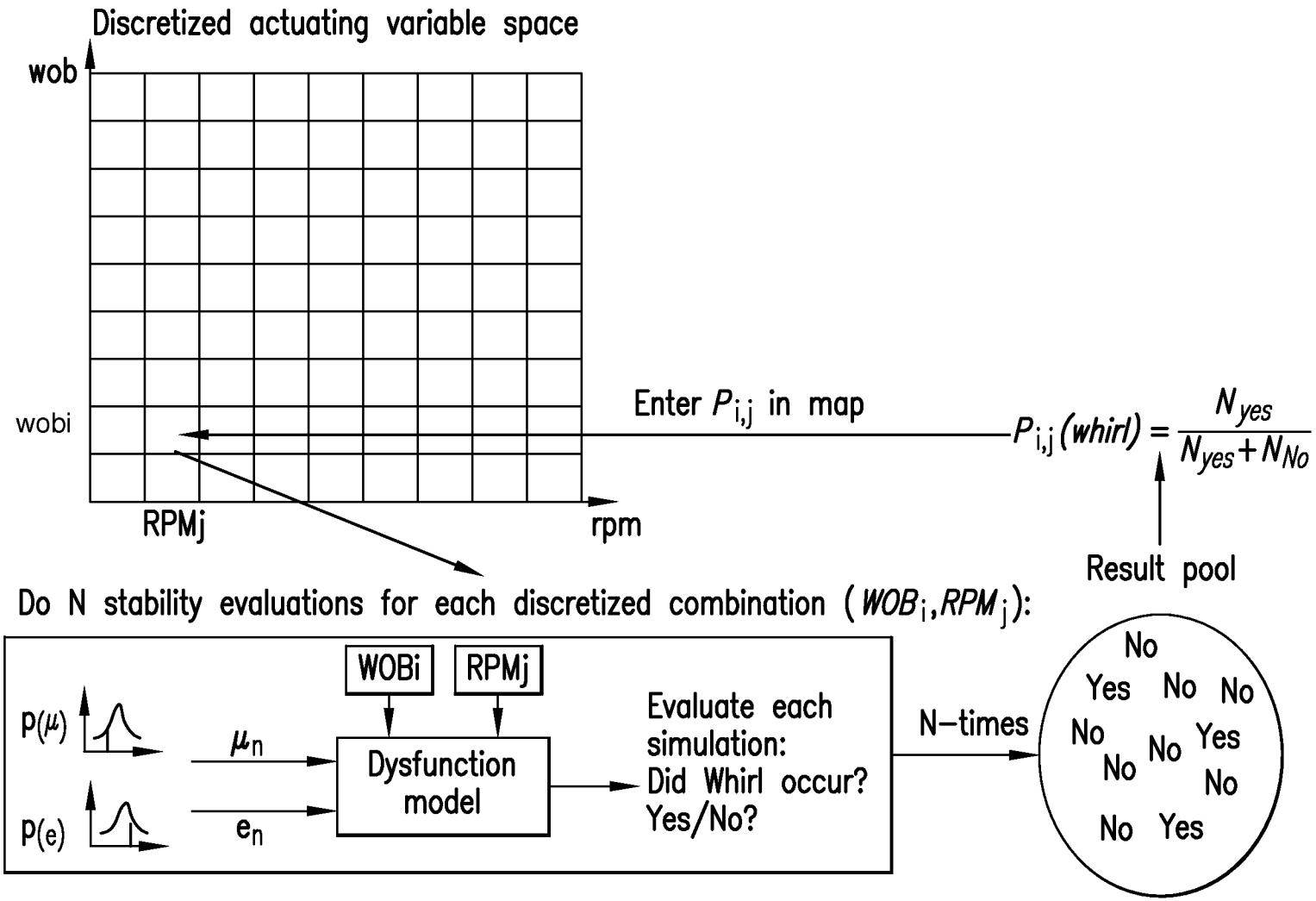
FIG. 3 depicts aspects of a first method of calculating the probability of a specific drilling dysfunction occurring.

The probability of the selected drilling dysfunction occurring may be calculated using various methods. In a first exemplary method as illustrated in FIG. 3, an actuating variable space (e.g., WOB-RPM plane) is discretized. For each discretized combination of actuating variables, a Monte Carlo simulation is performed. The Monte Carlo simulation includes N stability evaluations of the dysfunction model. In each of the N stability evaluations, the values of the uncertain parameters (e.g., drill string friction, eccentricity, and damping) are varied according to their probability distribution. The result of each of the N stability evaluations is if the dysfunction occurs or not. If the dysfunction occurs, then the total number of dysfunction occurrences (N_dysfunction) is incremented. For each discretized combination of actuating variables, the probability of the dysfunction is P=N_dysfunction/N. The result is a probability P_dysfunction=f(actuating variables), e.g., P_whirl=f(RPM. WOB). This can be plotted as a color coded map or surface plot.

Figure 4:
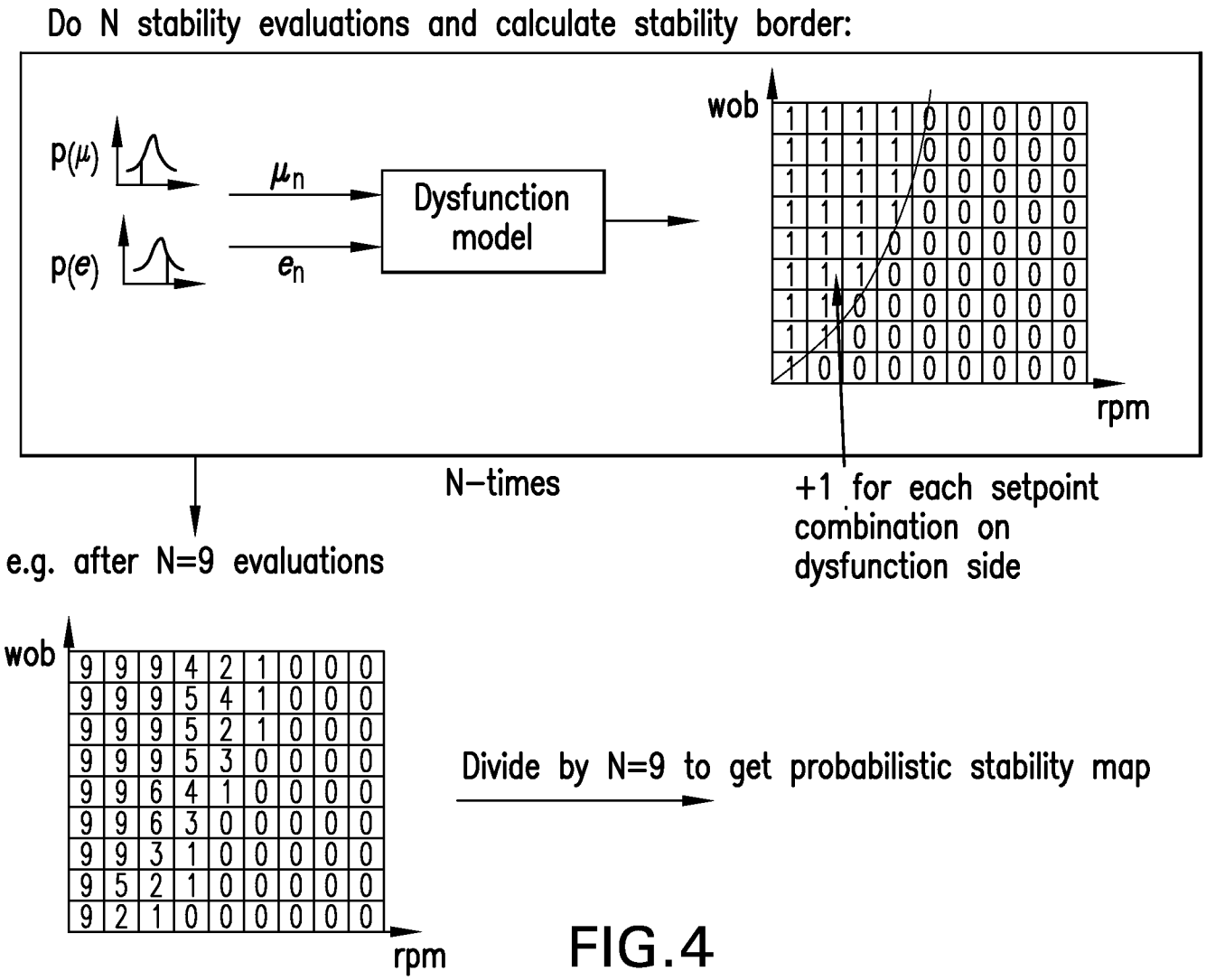
FIG. 4 depicts aspects of a second method of calculating the probability of a specific drilling dysfunction occurring.

In a second exemplary method as illustrated in FIG. 4, an actuating variable space (e.g., WOB-RPM plane) is again discretized and for each discretized combination of actuating variables, a Monte Carlo simulation that includes N stability evaluations of the dysfunction model is performed. Also again, in each of the N stability evaluations, the values of the uncertain parameters (e.g., drill string friction, eccentricity, and damping) are varied according to their probability distribution. The result of each of the N stability evaluations in this method is a stability border which divides the actuating space into stable and an unstable region. If a discretized combination of actuating variables in the unstable region, then the total number of dysfunction occurrences (N_dysfunction) is incremented for this combination of actuating variables. For each discretized combination of actuating variables, the probability of the dysfunction is calculated according to P=N_dysfunction/N. The result is a probability P_dysfunction=f(actuating variables), e.g., P_whirl=f(RPM. WOB). This can also be plotted as a color coded map or surface plot.

Various mathematical techniques may be used to improve the efficiency of running the Monte Carlo simulations. These techniques may include Markow chain Monte Carlo simulations (e.g., Metropolis algorithm) and variance reduction techniques such as antithetic variates, stratified sampling, importance sampling, and control variates. It can be appreciated that other types of mathematical techniques may be used to perform the simulations such as Random Walk or entering probability distribution functions (where the probability distribution function is described analytically, e.g., f(x)) directly into the models.

Figure 5:
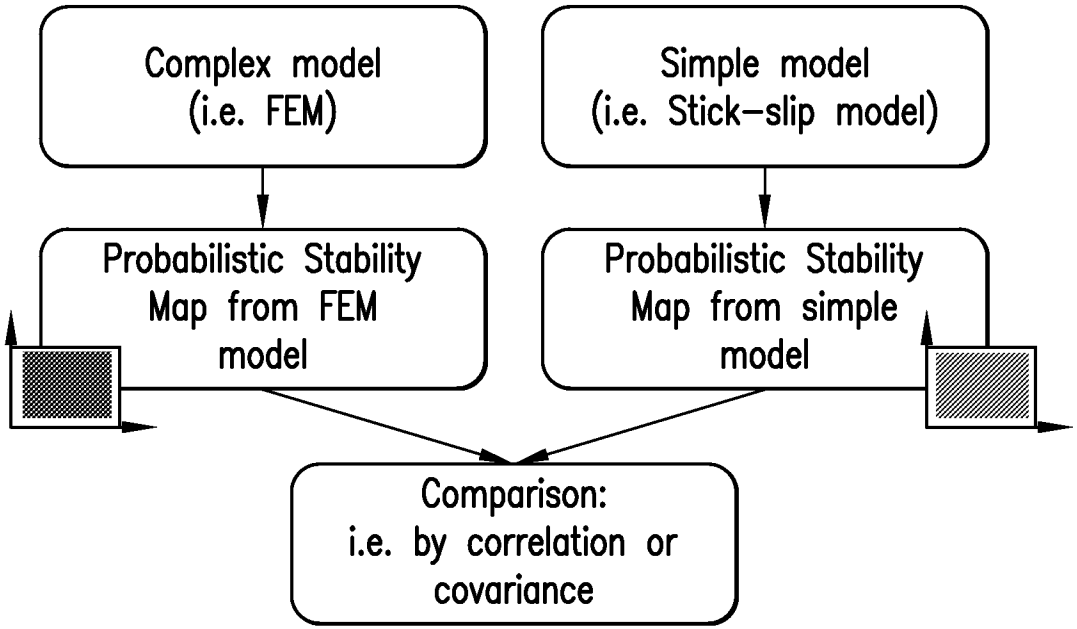
FIG. 5 is a flow chart for a method of comparing mathematical drill string models having different levels of fidelity or complexity.

In order to improve computational efficiency, the method 20 may also include comparing the output obtained using a high fidelity or complexity model to the output obtained using a lower fidelity or complexity model as illustrated in FIG. 5. In general, the high fidelity or complexity model uses more computational time than a lower fidelity or complexity model. If the outputs are comparable or within a selected range, then the lower fidelity or complexity model may be used to perform the drilling simulations going forward. As illustrated in FIG. 5, one method of comparison includes generating a probabilistic stability map using each model and then performing a comparison of the maps obtained from each model. In one or more embodiments, the comparison provides a quantitative measurement characterizing a difference between the maps. Non-limiting examples of comparison methods that provide a quantitative measurement include mathematical correlation and mathematical covariance. The method 20 may thus include: performing the plurality of simulations for a plurality of models having various levels of fidelity in representing the drill string using the same data and drilling parameters; providing a probabilistic stability map from each of the models; performing a comparison of the map obtained from the highest fidelity model to other maps obtained using lower fidelity models to provide a quantitative measurement of the comparison; identifying a probabilistic stability map obtained using a lowest fidelity model that provides a corresponding quantitative measurement that is within an acceptance criterion for quantitative comparison measurements; and performing the plurality of drilling simulations using the identified lowest fidelity model going forward.

Figure 6:
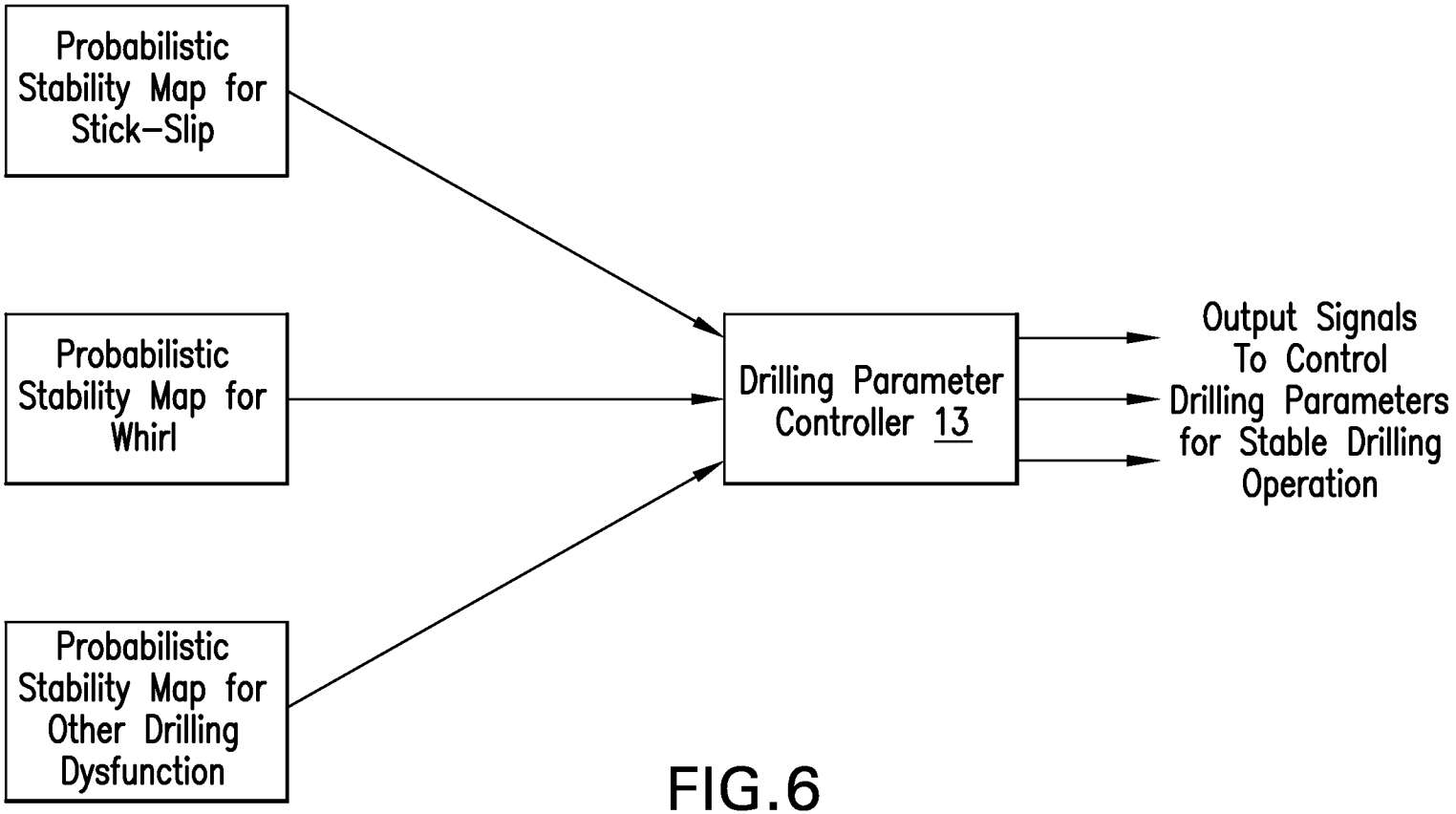
FIG. 6 is a flow chart for using predicted drilling stability maps to automatically control drilling parameters.

From the plurality of drilling simulations, a corresponding plurality of data groups will be provided. Each data group may include (i) the drilling parameters used in the corresponding simulation, (ii) if the selected drilling dysfunction occurred, and (iii) the probability of the combination of the drilling related data used in the simulation occurring and thus the probability of the selected drilling dysfunction occurring. The method 20 may include inputting the data groups into a controller for automatically controlling the drilling parameters to prevent the drilling dysfunction while the borehole is being drilled as illustrated in FIG. 6. The controller may include an algorithm configured to control drilling parameters for drilling a borehole such that the combination of values of the controlled drilling parameters coincide with drilling parameter values associated with a probability of a drilling dysfunction determined by simulation that is less than or equal to a selected probability. The algorithm may include a drilling parameter setpoint such that the probability of any drilling dysfunction occurring at the setpoint is less than or equal to the selected probability. The setpoint may relate to a certain combination of drilling parameters. In one or more embodiments, the selected probability is a minimum probability of all probabilities determined from the simulations. In other embodiments, the selected probability may not be the minimum probability but a somewhat higher probability in order to balance the risk of a drilling dysfunction or combination of different drilling dysfunctions with an increase in the rate of penetration (ROP) while drilling or other drilling performance indicator.

Figure 7:
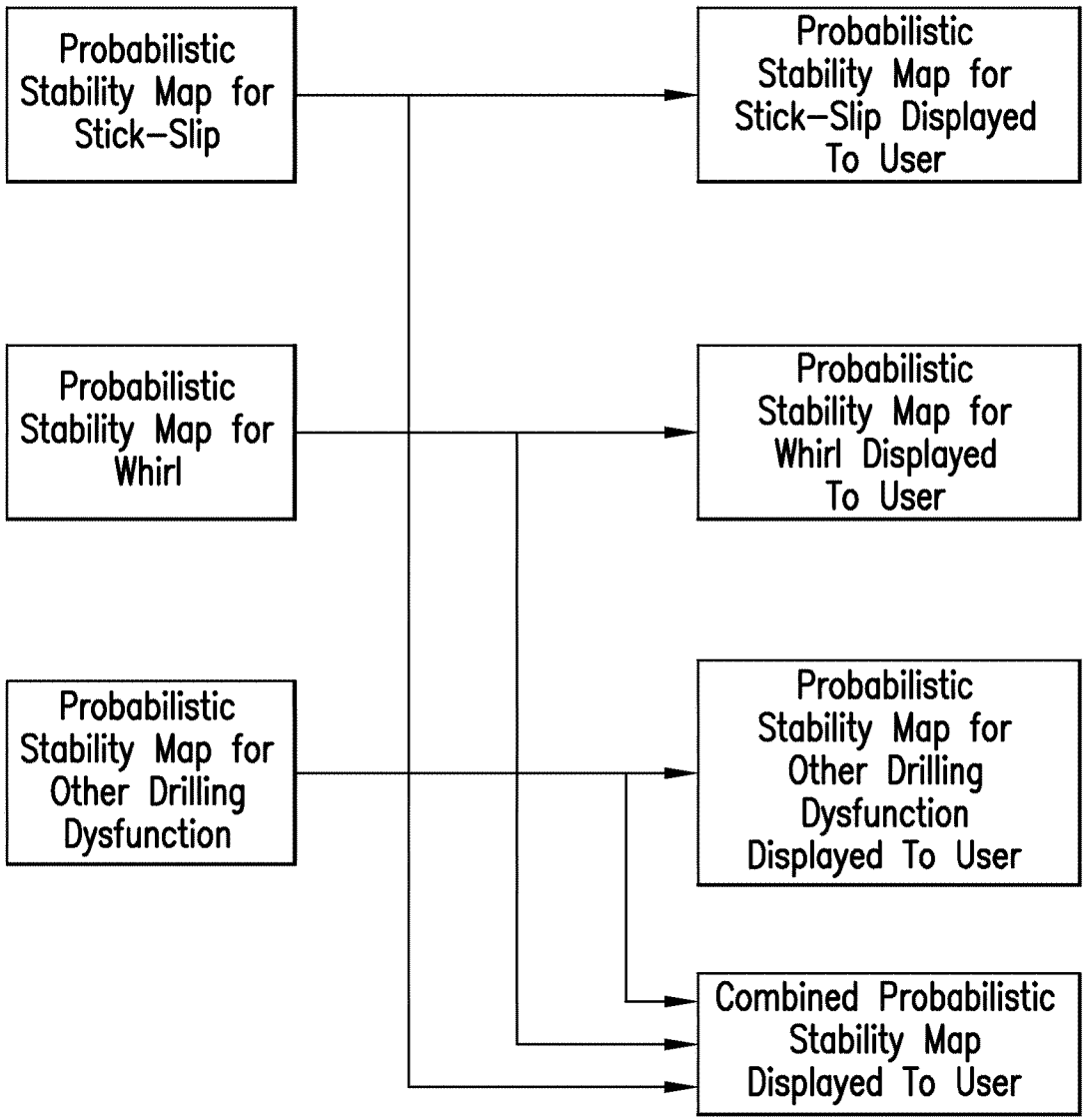
FIG. 7 is a flow chart for using predicted drilling stability maps to present a graph of drilling stability to a user.

It can be appreciated that a plurality of models may be used to perform the drilling simulations with each model modelling a different drilling dysfunction. For example a first model may model stick-slip while a second model may model drill bit whirl or lateral vibrations that exceed a threshold. Each probabilistic drilling stability map associated with each drilling dysfunction may be displayed to a user, as illustrated in FIG. 7, such as a drilling operator who can make drilling decisions based on the displayed information. Alternatively or in addition to displaying individual drilling stability maps, the probabilistic drilling stability maps for each drilling dysfunction may be combined into one composite probabilistic drilling stability map as also illustrated in FIG. 7. Different techniques to combine the maps such as summing, multiplying or averaging the stability probabilities or using a maximum value from all of the stability probabilities for a certain combination of drilling parameters may be used as non-limiting examples. In addition, the stability probabilities may be weighted based on importance of the associated drilling dysfunction with respect to the other drilling dysfunctions. Once weighted, operations such as the summing, multiplying, averaging, maximum value selection may be applied to the weighted stability probabilities. The drilling stability zones (i.e., drilling parameter zones not having any drill dysfunction) from the various models may be combined to give a composite zone where there is no type of drilling dysfunction for particular sets of drilling parameters.

Figure 8:
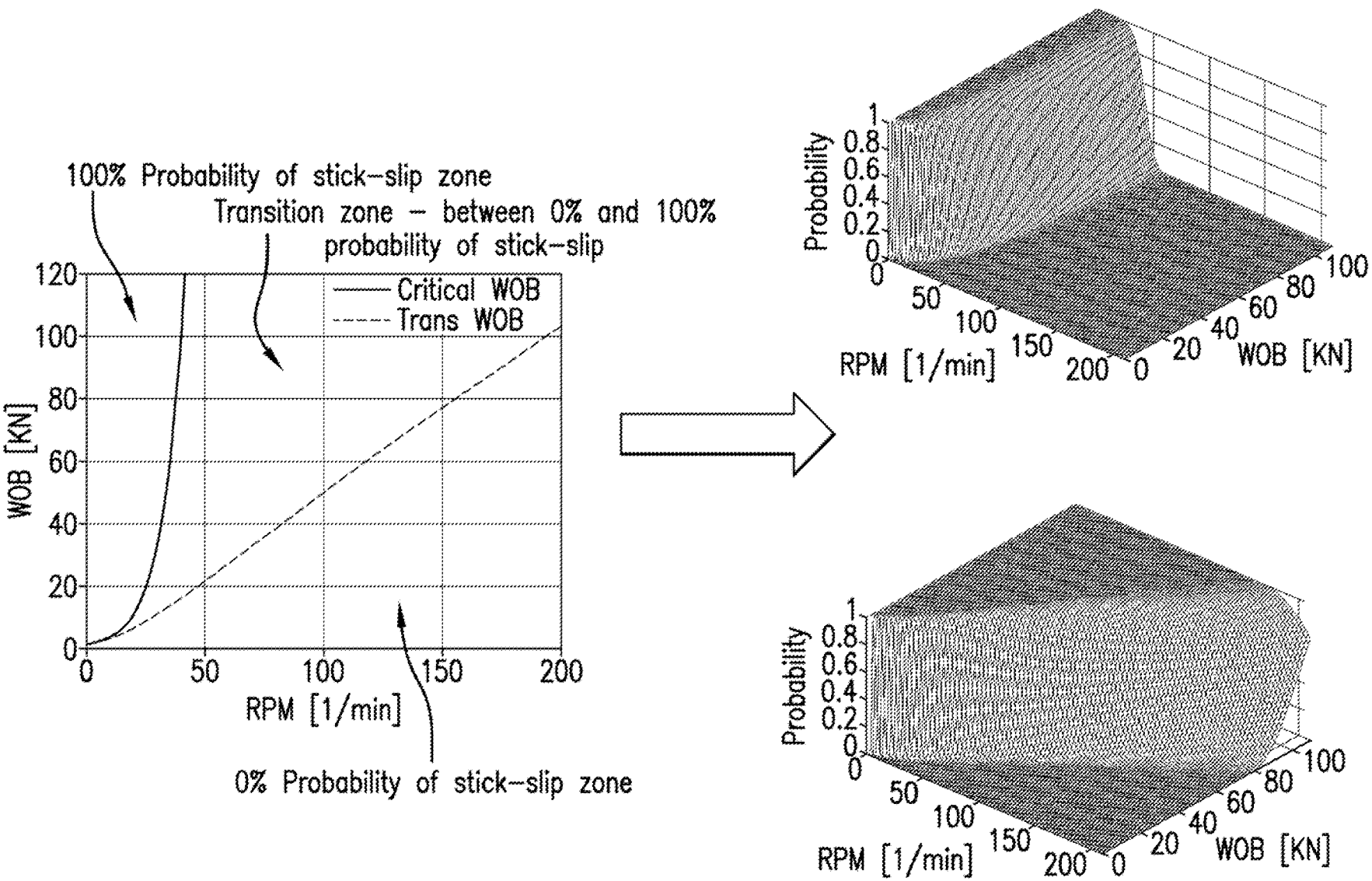
FIG. 8 is a flow chart for a method of optimizing a drilling performance indicator.

The plurality of data groups may be used to plot a graph of the probability of a selected drilling dysfunction occurring for a particular set of drilling parameters (see right side of FIG. 8 for example). In one or more embodiments, the graph may be three-dimensional or multi-dimensional in order to display the probability and associated drilling parameters. In general, the number of dimensions in the stability map takes into account the number of different types of drilling parameters (e.g., RPM. WOB, drilling fluid flow rate) and the probability of the drilling dysfunction occurring for the different combinations of the plotted drilling parameters.

Examples of stick-slip stability maps are now presented. A falling characteristic of the torque with respect to the RPM is assumed which can lead to a self-excitation of the first torsional mode of the system. Two stability borders can be calculated: The first is the transition between no stick-slip and stick-slip if the RPM fluctuation is zero. The second is the transition between stick-slip and no stick-slip if a full stick slip cycle is occurring. These two borders are caused by the nonlinear characteristics of the torque vs. RPM. If the parameters of the falling torque characteristics and the modal damping are constant these borders are lines. A transition occurs directly at these lines. In real applications, the transition is a zone with different probabilities of stick slip because of the variation of the damping and parameters of the falling torque characteristics. FIG. 8 (right side) illustrates examples of graphs that may be displayed to a user via a computer display. The upper right graph depicts the probability for stick-slip with values between 0 (no chance of stick-slip) and 1 (100% chance of stick-slip) for the case of no RPM fluctuation while the lower right figure illustrates the case for fully developed stick slip. Herein parameters of the falling torque characteristics and damping have been varied. It can be seen from these graphs that there is a transition zone where the probability for stick-slip is different from zero or one. Hence, WOB and RPM may be optimized to mitigate stick-slip and thus increase ROP. To mitigate stick-slip, RPM and WOB combinations with small values of a probability to get stick-slip can be selected from theses stability maps. In addition, minimizing the probability of stick-slip may decrease the risk of equipment damage.

Figure 9:
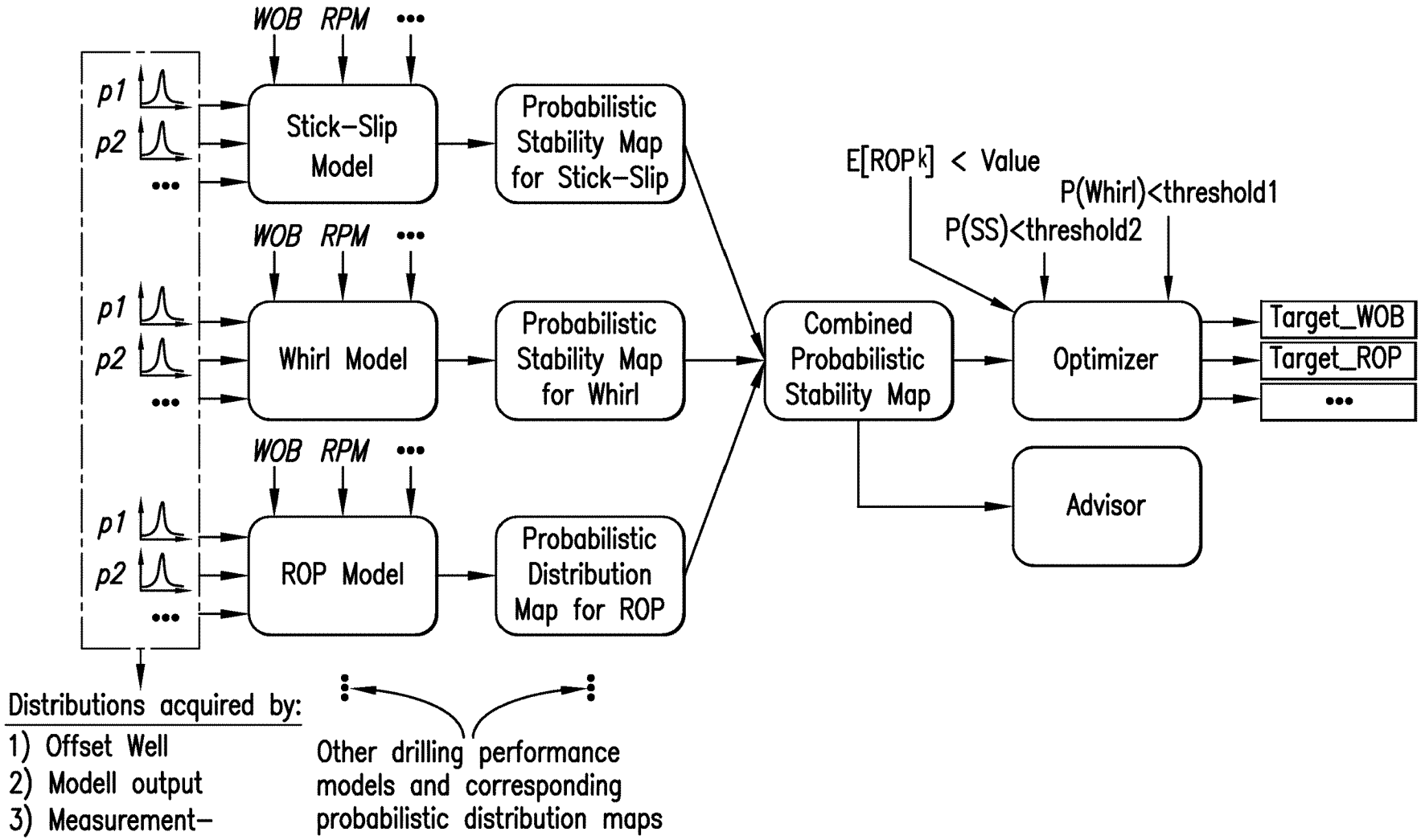
FIG. 9 depicts aspects of transformation of deterministic stability maps to probabilistic stability maps.

In addition to predicting drilling stability with a known probability for certain drilling dysfunctions, the probabilistic techniques disclosed herein may be used to select drilling parameters that optimize one or more drilling performance indicators such as ROP as illustrated in FIG. 9. Similar to the probabilistic drilling stability maps, probabilistic drilling performance maps may be produced that indicate the probability of a certain drilling performance indicator value occurring for certain combinations of drilling parameters. As with the probabilistic drilling stability maps, the probabilistic drilling performance maps may be displayed individually to a user, may be combined with other probabilistic drilling performance maps, or may be further combined with the probabilistic drilling stability maps to provide one composite probabilistic map. The "Advisor" in FIG. 8 relates to displaying individual or composite probabilistic maps to a user. Alternatively or in addition to the displaying the composite probabilistic map, an "Optimizer" may execute an algorithm to select certain drilling parameters from the composite map that provide drilling stability and meet drilling performance indicator objectives within a selected range of probabilities. The Optimizer may be a controller such as the drilling parameter controller 13 that provides automatic control of the drilling parameters.

It can be appreciated that the Optimizer may be used to optimize drilling parameters such as ROP and build rate including expected value E[ ], variance Var[ ], convariance COV, correlation Con and other stochastical moments E[X^k] related to drilling performance. The optimization may be weighted with k_1, k_2, . . . (can also be negative values). An abitrary function f can be used which combines theses values. A function such as $\mathrm{Max}(k_1E(ROP)+k_2E(\text{Build Rate})+k_3\mathrm{Var}(ROP)+k_4\mathrm{Var}(\text{Build Rate})+f(COV, E, Var, Corr, E(X^k)))$ may then be maximized. Constraints may be used for the probability of dysfunctions or other values as illustrated in FIG. 8. Constraints can also include stochastical moments or functions of stochastical moments. Examples of constraints used in FIG. 8 include Prob(Whirl)<0.95, Prob (SS)<0.95, and $E[ROP^k]$<Value.

It can be appreciated that the probabilistic drilling stability maps and the probabilistic drilling performance maps may be used to design the BHA 10. By selecting certain BHA design parameters such as dimensions, weights, and material characteristics, these design parameters can be entered into the drill string model. Drilling simulations may then be performed using the model to calculate the associated probabilistic drilling stability maps and the probabilistic drilling performance maps. These maps may then be analyzed to determine if the design parameters lead to acceptable drilling performance or not. If not, then the design parameters may be changed and new maps calculated using the disclosed techniques. This may result in an iterative process until design parameters are selected that lead to acceptable drilling performance.

It can be appreciated that the model used for performing the drilling simulations may also be configured to predict a borehole drilling characteristic such as borehole path, dog-leg severity, build rate, and walk rate. The drilling simulations may then be used to determine a probability of a certain borehole characteristic value occurring based on the entered drilling parameters and the probability distributions of the entered drilling-related data. Unknown proposed parameters of the optimization and/or prediction probabilistic techniques (e.g., friction factor, formation properties, and drill bit aggressiveness) are considered by estimating their mean values and their distribution based on offset wells, historical data or laboratory experiments.

In support of the teachings herein, various analysis components may be used, including a digital and/or an analog system. For example, the downhole electronics 9, the computer processing system 11, or the drilling parameter controller 13 may include digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure. Processed data such as a result of an implemented method may be transmitted as a signal via a processor output interface to a signal receiving device. The signal receiving device may be a display monitor or printer for presenting the result to a user. Alternatively or in addition, the signal receiving device may be memory or a storage medium. It can be appreciated that storing the result in memory or the storage medium will transform the memory or storage medium into a new state (containing the result) from a prior state (not containing the result). Further, an alert signal may be transmitted from the processor to a user interface if the result exceeds a threshold value.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used to connect at least two terms is intended to mean any term or combination of terms. The term "configured" relates one or more structural limitations of a device that are required for the device to perform the function or operation for which the device is configured. The terms "first" and "second" do not denote a particular order, but are used to distinguish different elements. The term "optimize" does not necessarily relate to selecting a maximum or minimum value but may include selecting a value within a selected range of a maximum or minimum value or selecting a value within a selected range of a desired value based upon the circumstances for optimization.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for selecting drilling parameters, the method comprising:

entering drilling-related data comprising one or more physical properties having a probability distribution of data related to operation of a drill string into a mathematical model of a drill string drilling a borehole penetrating the earth, wherein the drilling-related data comprises a plurality of values for each of the one or more physical properties and a corresponding probability of each of the values occurring and the mathematical model comprises a structure of the drill string;

entering drilling parameters into the model of the drill string drilling the borehole; and performing a plurality of drilling simulations using the model, wherein the plurality of drilling simulations includes a plurality of evaluations and in each evaluation in the plurality of evaluations the values of the one or more physical properties are varied according to their probability distribution, each simulation providing a probability of a specific drilling dysfunction occurring or a probability of a specific drilling performance indicator value related to operation of the drill string occurring with the entered drilling parameters used in the simulation;

selecting a set of the entered drilling parameters that optimizes a drilling objective comprising performance of the drill string using the probability of the specific drilling dysfunction occurring or the probability of the specific drilling performance indicator value related to operation of the drill string occurring;

transmitting the selected set of the entered drilling parameters to a signal receiving device comprising a drilling parameter controller; and controlling the operation of the drill string using the selected set of the entered drilling parameters with the drilling parameter controller;

wherein the method further comprises selecting a weight for the probability of a specific drilling dysfunction occurring or the probability of a specific drilling performance indicator value related to operation of the drill string occurring, the weight being based on importance of an associated drilling dysfunction with respect to another drilling dysfunction or an associated drilling performance indicator with respect to another drilling performance indicator; and wherein entering the drilling-related data, entering the drilling parameters, performing the plurality of drilling simulations and selecting the set of the entered drilling parameters are performed using a processor.

2. The method according to claim 1, further comprising plotting the probability of each of the drilling simulations and at least one of the entered drilling parameters in a graph.

3. The method according to claim 2, wherein:

the specific drilling dysfunction occurring comprises a first specific drilling dysfunction occurring and a second specific drilling dysfunction occurring;

the plurality of drilling simulations comprises (i) a first plurality of drilling simulations providing a first probability of the first specific drilling dysfunction occurring and entered drilling parameters and (ii) a second plurality of drilling simulations providing a second probability of the second specific drilling dysfunction occurring and entered drilling parameters;

and the method further comprises plotting the first probability and entered drilling parameters and the second probability and entered drilling parameters in order to plot the graph.

4. The method according to claim 1, further comprising entering the probability of the specific drilling dysfunction occurring and entered drilling parameters into the drilling parameter controller that is configured to control drilling parameters to prevent the specific drilling dysfunction occurring while the borehole is being drilled.

5. The method according to claim 4, wherein the controller comprises an algorithm configured to control drilling parameters for drilling a borehole such that values of the controlled drilling parameters coincide with entered drilling parameters with a probability of the specific drilling dysfunction occurring determined by the drilling simulation that is less than or equal to a selected probability.

6. The method according to claim 5, wherein the algorithm comprises a drilling parameter setpoint such that the probability of the specific drilling dysfunction occurring determined by the drilling simulations with the drilling parameter-setpoint is less than or equal to the selected probability.

7. The method according to claim 6, wherein the selected probability is a minimum probability of all probabilities of the specific drilling dysfunction occurring provided by the drilling simulations.

8. The method according to claim 1, further comprising:

performing the plurality of drilling simulations for a plurality of models having various levels of fidelity in representing the drill string using the same drilling-related data and entered drilling parameters;

comparing probabilities for the specific drilling dysfunction occurring as determined using the plurality of models;

identifying a lowest fidelity model that provides probabilities of the specific drilling dysfunction occurring within a selected range of the probabilities provided by the highest fidelity model; and performing the plurality of drilling simulations using the identified lowest fidelity model.

9. The method according to claim 1, wherein the plurality of drilling simulations is performed in accordance with a Monte Carlo method.

10. The method according to claim 1, wherein the entered drilling parameters comprise at least one of weight-on-bit, rotational speed, and drilling fluid flow rate.

11. The method according to claim 1, wherein the specific drilling dysfunction occurring comprises at least one of drill string stick-slip and drill string whirl.

12. The method according to claim 1, wherein entering drilling-related data comprises receiving measurements performed by a sensor disposed on the drill string drilling the borehole.

13. The method according to claim 1, wherein the drilling objective is a selected probability of avoiding a drilling dysfunction occurring, a selected probability of achieving a desired drilling performance indicator value related to operation of the drill string occurring, or combination thereof.

14. The method according to claim 1, wherein the specific drilling performance indicator value related to operation of the drill string occurring is a rate-of-penetration value, build rate value, or combination thereof.

15. The method according to claim 1, further comprising:

selecting a drill string design parameter;

entering the drill string design parameter into the model;

performing the plurality of drilling simulations using the model with the drill string design parameter, each drilling simulation providing a probability of the specific drilling dysfunction occurring or a probability of the specific drilling performance indicator value related to operation of the drill string occurring with the entered drilling parameters and the design parameter used in the drilling simulation;

determining if the probability of the specific drilling dysfunction occurring or the specific probability of a drilling performance indicator value related to operation of the drill string occurring is within an acceptance criterion; and iterating the selecting, entering, performing, and determining if the probability of the specific drilling dysfunction occurring or the probability of the specific drilling performance indicator value related to operation of the drill string occurring is not within the acceptance criterion.

16. The method according to claim 1, wherein the model is configured to predict a borehole drilling characteristic, and the method further comprises determining a probability of a certain borehole characteristic value.

17. The method according to claim 16, wherein the borehole drilling characteristic is one of borehole path, dogleg severity, build rate, and walk rate.

18. A non-transitory computer readable medium comprising computer-readable instructions for selecting drilling parameters that when executed by a computer causes apparatus to implement a method comprising:

entering drilling-related data comprising one or more physical properties having a probability distribution of data related to operation of a drill string into a mathematical model of a drill string drilling a borehole penetrating the earth, wherein the drilling-related data comprises a plurality of values for each of the one or more physical properties and a corresponding probability of each of the values occurring and the mathematical model comprises a structure of the drill string;

entering drilling parameters into the model of the drill string for drilling the borehole; and performing a plurality of drilling simulations using the model, wherein the plurality of drilling simulations includes a plurality of evaluations and in each evaluation in the plurality of evaluations the values of the one or more physical properties are varied according to their probability distribution, each simulation providing a probability of a specific drilling dysfunction occurring or a probability of a specific drilling performance indicator value related to operation of the drill string occurring with the entered drilling parameters used in the simulation; and selecting a set of the entered drilling parameters that optimizes a drilling objective comprising performance of the drill string using the probability of the specific drilling dysfunction occurring or the probability of the specific drilling performance indicator value related to operation of the drill string occurring; and transmitting the selected set of the entered drilling parameters to a signal receiving device comprising a drilling parameter controller;

controlling the operation of the drill string using the selected set of the entered drilling parameters with the drilling parameter controller;

wherein the method further comprises selecting a weight for the probability of a specific drilling dysfunction occurring or the probability of a specific drilling performance indicator value related to operation of the drill string occurring, the weight being based on importance of an associated drilling dysfunction with respect to another drilling dysfunction or an associated drilling performance indicator with respect to another drilling performance indicator.

19. The method according to claim 1, wherein a specific drilling dysfunction comprises a plurality of specific drilling dysfunctions and/or a specific drilling performance indicator value related to operation of the drill string comprises a plurality of specific drilling performance indicator values related to operation of the drill string and the method further comprises:

combining the probabilities of the plurality of specific drilling dysfunctions occurring and/or combining the probabilities of the plurality of specific drilling performance indicator values related to operation of the drill string occurring into a combined data set; and using the combined data set for the selecting.

20. The method according to claim 1, further comprising using a friction factor comprising a falling torque characteristic in the mathematical model.

* * * * *